US008183197B2

(12) United States Patent
Prabhat et al.

(10) Patent No.: US 8,183,197 B2
(45) Date of Patent: May 22, 2012

(54) PARTICLES COMPRISING A HUEING DYE

(75) Inventors: Manasvini Prabhat, Newcastle upon Tyne (GB); Gillian Balfour Swan, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/557,567

(22) Filed: Sep. 11, 2009

(65) Prior Publication Data

US 2010/0069282 A1 Mar. 18, 2010

(30) Foreign Application Priority Data

Sep. 12, 2008 (EP) ..... 08164303

(51) Int. Cl.

| | |
|---|---|
| ***C11D 17/06*** | (2006.01) |
| ***C11D 11/00*** | (2006.01) |
| ***C11D 3/40*** | (2006.01) |
| ***C11D 3/42*** | (2006.01) |
| ***D06L 3/12*** | (2006.01) |

(52) U.S. Cl. ..... 510/441; 510/276; 510/301; 510/394; 510/442; 8/648

(58) Field of Classification Search ..... 510/441, 510/442, 301, 349, 276, 394; 8/648
See application file for complete search history.

(56) References Cited

U.S. PATENT DOCUMENTS

| | | | | |
|---|---|---|---|---|
| 4,144,067 | A * | 3/1979 | Ruckert et al. | 430/324 |
| 4,228,042 | A | 10/1980 | Letton | |
| 4,239,660 | A | 12/1980 | Kingry | |
| 4,260,529 | A | 4/1981 | Letton | |
| 4,430,243 | A | 2/1984 | Bragg | |
| 4,483,779 | A | 11/1984 | Llenado et al. | |
| 4,483,780 | A | 11/1984 | Llenado | |
| 4,565,647 | A | 1/1986 | Llenado | |
| 4,912,203 | A * | 3/1990 | Kluger et al. | 534/729 |
| 5,017,195 | A * | 5/1991 | Satou et al. | 8/526 |
| 5,188,769 | A | 2/1993 | Connor et al. | |
| 5,332,528 | A | 7/1994 | Pan et al. | |
| 5,360,568 | A | 11/1994 | Madison et al. | |
| 5,360,569 | A | 11/1994 | Madison et al. | |
| 5,376,288 | A * | 12/1994 | Falholt et al. | 510/301 |
| 5,571,781 | A | 11/1996 | Boutique | |
| 5,576,282 | A | 11/1996 | Miracle et al. | |
| 5,595,967 | A | 1/1997 | Miracle et al. | |
| 5,597,936 | A | 1/1997 | Perkins et al. | |
| 5,620,952 | A | 4/1997 | Fu et al. | |
| 5,753,599 | A | 5/1998 | Coope et al. | |
| 5,756,440 | A * | 5/1998 | Watanabe et al. | 510/191 |
| 5,817,614 | A | 10/1998 | Miracle et al. | |
| 5,958,853 | A * | 9/1999 | Watanabe | 510/192 |
| 6,004,922 | A | 12/1999 | Watson et al. | |
| 6,020,303 | A | 2/2000 | Cripe et al. | |
| 6,022,844 | A | 2/2000 | Baillely et al. | |
| 6,025,319 | A * | 2/2000 | Surutzidis et al. | 510/441 |
| 6,093,856 | A | 7/2000 | Cripe et al. | |
| 6,113,677 | A * | 9/2000 | Kaufmann | 106/31.27 |
| 6,136,769 | A | 10/2000 | Asano et al. | |
| 6,150,322 | A | 11/2000 | Singleton et al. | |
| 6,153,577 | A | 11/2000 | Cripe et al. | |
| 6,207,632 | B1 | 3/2001 | Brooker et al. | |
| 6,221,825 | B1 | 4/2001 | Williams, Jr. et al. | |
| 6,225,464 | B1 | 5/2001 | Hiler, II et al. | |
| 6,306,812 | B1 | 10/2001 | Perkins et al. | |
| 6,326,348 | B1 | 12/2001 | Vinson et al. | |
| 6,482,994 | B2 | 11/2002 | Scheper et al. | |
| 6,649,085 | B2 | 11/2003 | Reinhardt et al. | |
| 6,844,309 | B1 | 1/2005 | Sivik et al. | |
| 7,208,459 | B2 | 4/2007 | Sadlowski et al. | |
| 7,501,389 | B2 | 3/2009 | Hage et al. | |
| 2003/0045446 | A1 * | 3/2003 | Dihora et al. | 510/320 |
| 2005/0113246 | A1 | 5/2005 | Hiler et al. | |
| 2005/0245419 | A1 * | 11/2005 | Guzmann et al. | 510/407 |
| 2006/0111264 | A1 * | 5/2006 | Smets et al. | 510/475 |
| 2006/0287211 | A1 | 12/2006 | Barbizan et al. | |

FOREIGN PATENT DOCUMENTS

| | | | | |
|---|---|---|---|---|
| JP | 05140590 | A | * | 6/1993 |
| WO | WO 92/06162 | A1 | | 4/1992 |
| WO | WO 98/35002 | A1 | | 8/1998 |
| WO | WO 98/35003 | A1 | | 8/1998 |
| WO | WO 98/35004 | A1 | | 8/1998 |
| WO | WO 98/35005 | A1 | | 8/1998 |
| WO | WO 98/35006 | A1 | | 8/1998 |
| WO | WO 00/47708 | A1 | | 8/2000 |
| WO | WO 00/32601 | A3 | | 10/2000 |
| WO | WO 2006/117301 | A1 | * | 11/2006 |
| WO | WO 2007/124370 | A1 | | 11/2007 |

OTHER PUBLICATIONS

International Search Report—6 pages, PCT/US2009/055668 mailed on Jan. 14, 2010.
U.S. Appl. No. 12/557,548, filed Sep. 11, 2009, Prabhat, et al.
U.S. Appl. No. 12/557,573, filed Sep. 11, 2009, Prabhat, et al.

* cited by examiner

*Primary Examiner* — Lorna M Douyon
(74) *Attorney, Agent, or Firm* — Julie A. McConihay; Leonard W. Lewis; Steven W. Miller

(57) ABSTRACT

A particle for use in a detergent composition. The particle can have a coating layer having a binder selected from the group consisting of surfactant, surfactant precursor, film-forming polymer, film forming inorganic salt, and mixtures thereof. The particle can have a core being at least partially coated by the coating layer. The particle can have a hueing dye.

6 Claims, No Drawings

PARTICLES COMPRISING A HUEING DYE

FIELD OF THE INVENTION

The present invention relates to a particle comprising a core, a coating, and a hueing dye, as well as compositions comprising such particles.

BACKGROUND OF THE INVENTION

Attempts have been made to incorporate particles comprising a dye into cleaning compositions, either to provide particular product aesthetics, blueing of the wash water, or even to increase perceived cleaning of white fabrics. When the dye is a hueing dye, the choice of the hueing dye and the way to incorporate it in a composition should be carefully monitored to avoid spotting or staining of the fabrics being laundered and/or to avoid the migration or the bleeding of the hueing dye across the composition which may lead to a rather unattractive composition.

WO 2005/003274 relates to laundry treatment compositions which comprise dye which is substantive to cotton. The dye may for example be included in a slurry which is sprayed dried or may be added to granules which are post-added to the main detergent powder. To avoid spotting, WO 2005/003274 teaches to have a concentration of dye in the granules of less than 0.1%.

The present inventors have now found that spotting or staining of the fabrics being laundered and migration or bleeding of the hueing dye across a composition could be reduced by the choice of specific particles. The particles of the invention can incorporate relatively high levels of hueing dye and enable use of such particles in compositions at relatively high levels without causing substantial staining or spotting and without substantially bleeding or migrating in the composition.

SUMMARY OF THE INVENTION

According to one of its aspects, the present invention concerns a particle, for use in a detergent composition, said particle comprising:

a coating layer comprising a binder selected from surfactant, surfactant precursor, film-forming polymer, film forming inorganic salt, and mixtures thereof, and a core being at least partially coated by said coating layer; wherein the particle comprises a hueing dye.

The invention also concerns a composition comprising the particles, for example at least 0.05% or at least 0.2 or 1% by weight of the particles and a cleaning adjunct material.

The invention also concerns the use of particles according to the invention in a composition to improve the aesthetic appearance of the composition and/or to hue fabrics to be washed without causing spotting of items to be washed and/or without causing bleeding in the composition.

The invention also concerns a process to prepare particles of the invention comprising the step of layering a mass of core, by a layering process comprising contacting said mass of core with a coating material comprising a liquid coating material having a viscosity of from about 1 mPa·s to about 100 000 mPa·s or 4000 mPa·s, and optionally independently contacting said mass of core with a coating material comprising a layering powder and optionally repeating said layering step.

DETAILED DESCRIPTION OF THE INVENTION

The invention concerns a particle comprising a core, a coating layer, and a hueing dye.

The Particle

The particle of the invention may be part of a composition comprising a plurality of particles according to the invention.

The particles may comprises 50 or 80 or 95% by weight of particles having a particle size distribution (PSD) between 100 μm and 5000 μm, typically 200 μm and 4000 μm, or between 400 μm and 2000 μm or even from 500 to 1500 μm. Typically, the particles of the present invention have a Mean Particle Size (MPS) between 200 μm and 2000 μm, or of a least 400, 500 or 600 μm and/or of less than 1000 μm or less than 700 μm. The Particle Size Distribution (PSD) and Mean Particle Size (MPS) of the particles of the present invention are measured as indicated below in the test method 1.

The particles may have a size distribution span of from about 1.0 to about 1.75, from about 1.05 to about 1.6, from about 1.1 to about 1.45, or even from about 1.1 to about 1.3.

The particles may have a bulk density of from about 350 g/l to about 2000 g/l, from about 500 g/l to about 1200 g/l, from about 600 g/l to about 1100 g/l, or even from about 700 g/l to about 1000 g/l. The bulk density may be measured as indicated in test method 2.

The particles may have a median particle aspect ratio of from about 1.0 to about 2.0, from about 1.05 to about 1.7 or even about 1.1 to about 1.4 or 1.25. The median particle aspect ratio may be measured as indicated in test method 3.

The particles may have an average per number sphericity above 0.5, for example above 0.7 or 0.8 or 0.9 or above 0.95. The sphericity may be measured as indicated in the test method 4.

The free moisture content (water that is not chemically bound) of the particle is typically comprised between 0% and 15% by weight of the particle, typically no greater than 10% by weight or even no greater than 5 or 2% by weight of the particle.

The particles may be coloured. By coloured, it should be understood that the particles are not white.

The particles comprise a core at least partially coated by at least a coating material.

As used herein, the term "at least partially coated" means a partial or complete coating of a coating material built up on the surface of the core. Typically, at least 40% of the surface of the core is covered by the coating material(s). For example, at least 50%, 75%, 85%, 90%, 95% or 99% of the surface of the core material is covered by coating material(s). Substantially up to 100% of the surface of the core may be covered by coating material(s).

The Coating Layer(s)

The particle comprises at least one coating layer. The particle may comprise several coating layers. The coating layer(s) may be substantially concentric. The coating may comprise discrete coating layer(s). The first coating layer is the layer directly coating the core. The last coating layer is the layer which is the outer-most layer of the particle. The coating layer(s) comprise(s) coating material(s). The coating material may comprise a binder and/or a layering powder.

At least one coating layer, for example the first coating layer is a binding layer. A binding layer comprises a binder selected from surfactant, surfactant precursor, film-forming polymer, film-forming inorganic salt, and mixtures thereof. Typically, a binding layer comprises at least 30% by weight, for example at least 40% or 50% or 60%, in particular at least 70% or 80% or 90% or even 95% or 99% by weight of a binder selected from surfactant, surfactant precursor, film-forming polymer, film-forming inorganic salt, and mixtures thereof.

At 80° C., 50° C., or at 25° C., the binder may be a liquid having a viscosity of from 1 mPa·s to 100 000 mPa·s, in particular a viscosity of at least 2 or 5 or 10 or even 20 or 100 mPa·s and/or of at most 10 000 or 5000 or 2000 or 1000 or even 500 mPa·s at a shear rate of 60 $s^{-1}$. If the binder is water-soluble, a 50% by weight solution of the binder in water may be a liquid having at 80° C., 50° C., or at 25° C., a viscosity of from 1 mPa·s to 100 000 mPa·s, in particular a viscosity of at least 2 or 5 or 10 or even 20 or 100 mPa·s and/or of at most 10 000 or 5000 or 2000 or 1000 or even 500 mPa·s at a shear rate of 60 $s^{-1}$. The viscosity may be measured as indicated in the test method 7.

At least one coating layer, for example the last coating layer, may comprise at least one coating material comprising a layering powder. The layering powder is preferably solid at 25° C. Typically, the layering powder is in a powder form which may have a MPS of from 2 μm to 700 μm or of from 50 μm to 300 μm. The layering powder may comprise material selected from the group consisting of surfactants, builders, clays, buffering agents, soluble polymers, optical brighteners, metal oxides, and mixtures thereof.

The coating layer(s) may comprise one or several coating layer(s) comprising a binder and/or a layering powder. The coating layer(s) may comprise a succession of, for example at least two or at least three and generally no more than 10, coating layer(s) comprising a binder and of coating layer(s) comprising a layering powder.

The coating layers may comprise at least two layers comprising a coating material selected from surfactant, surfactant precursor, builders, buffering agents, polymers, optical brighteners, metal oxides, film-forming polymer, film-forming inorganic salt, and mixtures thereof.

The coating layer(s) may comprise at least one layer, for example at least 2 or 3 layers comprising a coating material selected from acid surfactant precursors, surfactants, water-soluble polymers or their acid precursors, silicones, chelants, silicate, cellulosic materials, waxes, fatty acids, nutritional oils, builders, buffering agents, starches, optical brighteners, and mixtures thereof.

At least one coating layer, in particular a binding layer, may comprise at least one surfactant or surfactant precursor. Surfactants may be anionic, nonionic, zwitterionic, cationic, or mixtures thereof. In particular, the surfactant may be an anionic surfactant. Examples of suitable surfactants are given below in the definition of surfactants suitable as adjunct in the composition as a whole. Preferred anionic surfactants include alkyl sulphates and alkyl benzene sulphonates either alone or in admixture with one another or additional coating material. The surfactant precursor may be linear alkyl benzene sulphonic acid (HLAS).

At least one coating layer, in particular a binding layer, may comprise a film-forming material. A film-forming material may be a material that is able to form a film when cooling or drying. The film forming material may be a film-forming polymer or a film-forming inorganic salt.

At least one coating layer, in particular a binding layer, may comprise at least one film-forming polymer. The film-forming polymer may in particular be selected from synthetic organic polymers such as polyvinyl alcohol, polyethylene glycols, polyvinylpyrrolidones, polyacetates, polymeric polycarboxylates such as water-soluble acrylate (co)polymers, cationic polymers such as ethoxylated hexamethylene diamine quaternary compounds, starch, carboxymethylcellulose, glucose, sugars and sugar alcohol such as sorbitol, manitol, xylitol and mixtures thereof.

At least one coating layer, in particular a binding layer, may comprise at least one film-forming inorganic salt. The film-forming inorganic salt may be a silicate salt such as sodium silicate.

At least one coating layer, in particular a binding layer, may comprise a coating material which may gel at very high concentrations in aqueous detergent solutions, but at low concentrations such as in the wash water the coating material may substantially completely dissolve or disperse to enable the contents of the particle to be released in the wash water.

At least one coating layer may comprise a material selected from builders such as zeolite or phosphate builders, titanium dioxide, zinc oxide, calcium or sodium or magnesium carbonate, calcium or sodium or magnesium sulphate, talc, berytes, clay such as kaolin or bentonite, silicas, zinc sulphide, lithopone, and antimony trioxide. Further examples of builders are given below in the definition of builder suitable as adjunct in the composition as a whole.

At least one coating layer may comprise a material providing a pH of less than 7 when dissolved in water. A suitable example of such material is sodium sulphate. The use of such a material may be preferred in particular when used with alkaline sensitive material, such as alkaline sensitive hueing dye.

The coating material may comprise at least two layers, for example at least 3, or even at least 5 layers or 7 or 10 layers. The coating material may comprise less than 20 layers, for example less than 10 or less than 7 layers.

The Core

The particle comprises a core. The core comprises a core material which is preferably solid at 25° C.

The size of the core is preferably of from about 150 microns to about 1700 microns, from about 200 microns to about 1200 microns, from about 250 microns to about 850 microns, or even from about 300 microns to about 600 microns. The core may have bulk density of from about 50 grams per liter to about 2000 grams per liter, from about 200 grams per liter to about 1650 grams per liter, from about 350 to about 1200 grams per liter or even from about 400 grams per liter to about 850 grams per liter. The core may have a size distribution span of from about 1.0 to about 2.0, from about 1.05 to about 1.7, or even from about 1.1 to about 1.5; and optionally a median core aspect ratio of from about 1 to about 2, from about 1 to about 1.5, or even from about 1 to about 1.3.

The core may have an average per number sphericity above 0.5, for example above 0.7 or 0.8 or 0.9 or above 0.95.

The core may comprise a core material selected from, but not limited to, the group consisting of surfactants, builders, buffering agents, soluble polymers, clays, optical brighteners, metal oxides, and mixtures thereof.

The core may comprise a material selected from builders such as zeolite or phosphate builders, titanium dioxide, zinc oxide, calcium or sodium or magnesium carbonate, calcium or sodium or magnesium sulphate, talc, berytes, clay such as kaolin or bentonite, silicas, zinc sulphide, lithopone, and antimony trioxide. Further examples of builders are given below in the definition of builder suitable as adjunct in the composition as a whole.

The core may comprise a material providing a pH of less than 7 when dissolved in water. A suitable example of such material is sodium sulphate. The use of such a material may be preferred in particular when used with alkaline sensitive material, such as alkaline sensitive hueing dye.

The Hueing Dye

The particle comprises a hueing dye. The particle may comprise at least 0.1 wt %, typically at least 0.2 wt % or 0.5, or 1, or even 2 wt % or 5 wt % of hueing dye based on the total weight of the particle. The particle may contain up to 30 wt %, or up to 20 wt %, or up to 10 wt % per weight of a hueing dye.

The core may comprise a hueing dye. At least one layer of the coating layer(s) may comprise a hueing dye. The core and at least one coating layer may comprise a hueing dye. At least 2, 3, 5 or 7 of the coating layers may comprise a hueing dye. At least 25%, or 35%, 45, 55% or 65% (by number of layers) of the coating layers may comprise a hueing dye.

The concentration of hueing dye may be higher in the inner-most volume of the particle than in the outer-most volume of the particle. Less than 90%, or less than 70% or less than 50% or even less than 30% of the hueing dye may be in the outer-most volume of the particle, the outer-most volume of a particle being the part which is distant from the edge of the particle by a distance of less than d/10 or d/20 or d/40, with d being the diameter of the particle. Less than 10%, or less than 5% or less than 3% or even less than 2% of the hueing dye may be in the outer-most volume of the particle, the outer-most volume of a particle being the part which is at distant from the edge of the particle by a distance of less than d/30 or d/50 or d/100, with d being the diameter of the particle.

If the coating material comprises at least two layers, the concentration of hueing dye may be higher in the inner coating layer(s) of the particle than in the outer coating layer(s) of the particle. For example, the concentration of hueing dye in the first coating layer may be higher than the concentration of hueing dye in the last coating layer. If the particle comprises a coating material comprising at least 4 coating layers, the concentration of hueing dye in the two first coating layers may be higher than the concentration of hueing dye in the two last coating layers. If the particle comprises a coating material comprising at least 2n coating layers, the concentration of hueing dye in the n first coating layers may be higher than, for example 20%, 50% or 100% higher than, the concentration of hueing dye in the n last coating layers.

A hueing dye of the present invention may be a water soluble or water dispersible compound.

The particle comprising the hueing dye may be such that the hueing dye present in the particle of the invention is soluble at 25° C. in a mixture of 1 liter of deionized water and 1 mg, 10 mg, 100 mg, or 1 g of particles of the invention. If the particles are in a detergent or fabric treatment composition, said composition and said particles may be such that the hueing dye present in said composition is soluble at 25° C. in a mixture of 1 liter of deionized water and 10 mg, 100 mg, 1 g, or 10 g of said composition.

A hueing dye is defined as a dye which upon washing provides white fabrics with a light off-white tint, modifying whiteness appearance and acceptance (e.g. providing aqua, or blue, or violet, or pink hue). The hueing dye may have a substantially intense color as a raw material and may color a fabric by selectively absorbing certain wavelengths of light. Preferred hueing dyes include dyes that are such that the fabrics treated with said hueing dye according to the fabric substantive component test below (test method 5) show an average difference in hue of greater than 0.1, in particular greater than 0.2 or 0.5 units on either the a axis or b axis.

Preferred hueing dye exhibits a hueing efficiency of at least 1, or of at least 2, preferably of at least 5, 10 for example of at least 15. The hueing efficiency of a dye is measured as indicated in test method 6 below and is measured by comparing a fabric sample washed in a solution containing no dye with a fabric sample washed in a solution containing the dye, and indicates if a hueing dye is effective for providing the desired tinting, for example, whitening. Suitable hueing dyes may be hueing dyes described in U.S. Pat. No. 7,208,459.

The principle feature of dyes may be a conjugated system, allowing them to absorb energy in the visible part of the spectra. The most commonly encountered conjugated systems include phthalocyanine, anthraquinone, azo, phenyl groups, referred to as chromophore. Dyes can be, but are not required to be, chosen from the following categories: reactive dyes, direct dyes, sulphur and azoic dyes, acid dyes, and disperse dyes.

The hueing dye may be a photobleach. Photobleaches are molecules which absorb the energy from sunlight and transfer it by reacting with another molecule (typically oxygen) to produce bleaching species (singlet oxygen). Photobleaches generally comprise conjugated rings, and therefore usually present a strong visible color. Typical photobleaches comprises phthalocyanines based on zinc, copper, silicon, or aluminum.

The hueing dye may have the following structure of formula I:

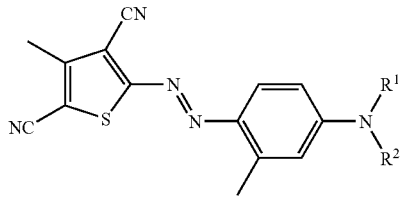

wherein each $R^1$ and $R^2$ are independently selected from the group consisting of R, —[$(CH_2CR'HO)_x(CH2CR''HO)_y$ H], and mixtures thereof, wherein R is independently selected from H, $C_1$-$C_4$ linear or branched alkyl, benzyl and mixtures thereof; each R' is independently selected from the group consisting of H, $CH_2O(CH_2CH_2O)_zH$, and mixtures thereof, and each R'' is selected from the group consisting of H, $CH_3$, $CH_2O(CH_2CH_2O)_zH$, and mixtures thereof; wherein $x+y \leqq 5$; wherein $y \geqq 1$; and wherein z=0 to 5.

The compounds of formula I may be synthesized according to the procedure disclosed in U.S. Pat. No. 4,912,203 to Kluger et al.

In particular, the hueing dye of formula I may be one of the following compounds 1-5:

Compound 1

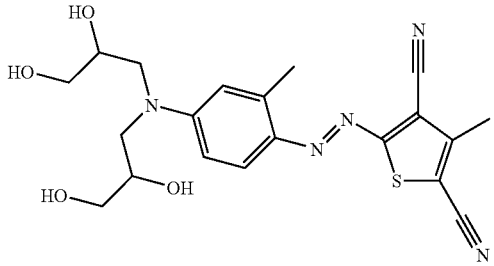

-continued
Compound 2
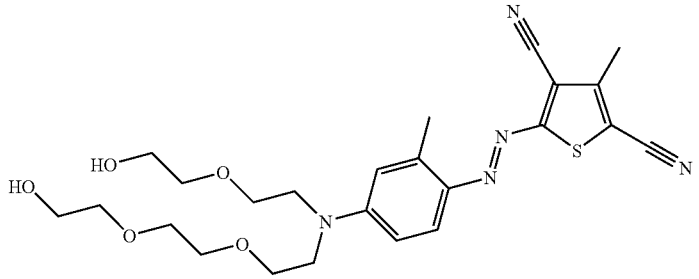
Compound 3
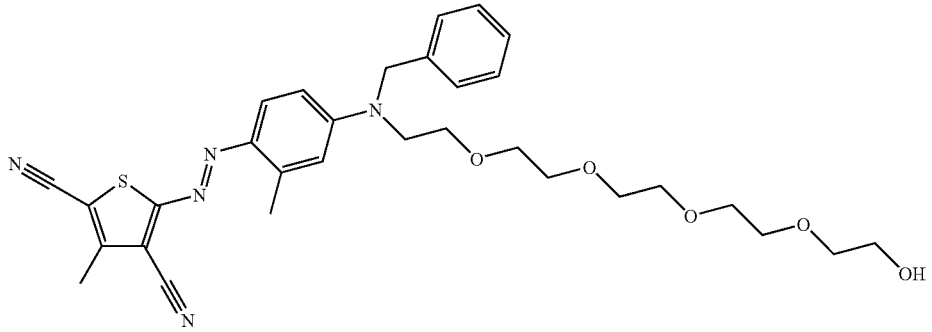
Compound 4
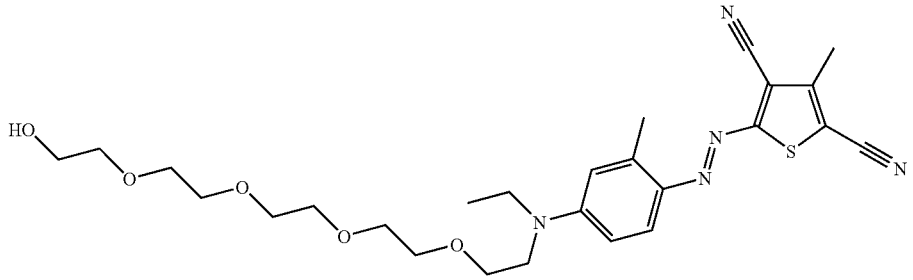
Compound 5
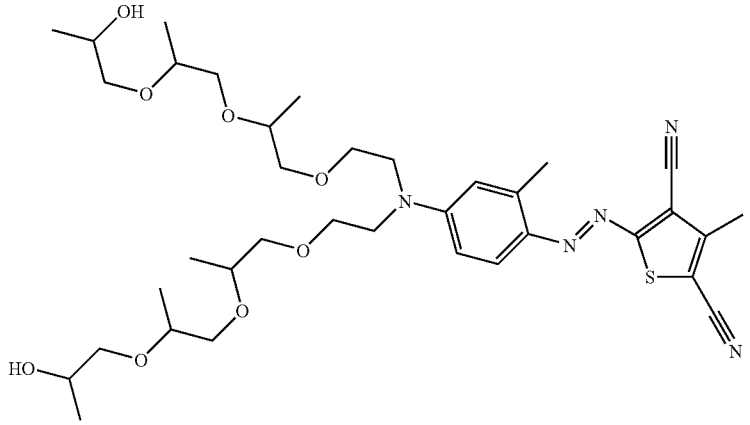

The hueing dye may be a small molecule dye or a polymeric dye. Suitable small molecule dyes include, but are not limited to, small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example:

(1) Tris-Azo Direct Blue Dyes of the Formula

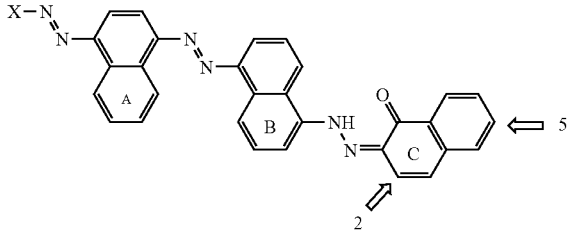

where at least two of the A, B and C naphthyl rings are substituted by a sulfonate group, the C ring may be substituted at the 5 position by an $NH_2$ or NHPh group, X is a benzyl or naphthyl ring substituted with up to 2 sulfonate groups and may be substituted at the 2 position with an OH group and may also be substituted with an $NH_2$ or NHPh group.

(2) Bis-Azo Direct Violet Dyes of the Formula:

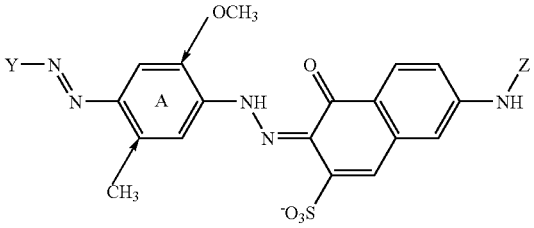

where Z is H or phenyl, the A ring is typically substituted by a methyl and methoxy group at the positions indicated by arrows, the A ring may also be a naphthyl ring, the Y group is a phenyl or naphthyl ring, which may be substituted with one or more sulphonate group(s) and may be mono or disubstituted by methyl groups.

(3) Blue or Red Acid Dyes of the Formula

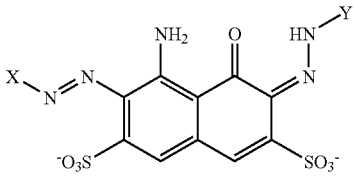

where at least one of X and Y must be an aromatic group. In one aspect, both the aromatic groups may be a substituted phenyl or naphthyl group, which may be substituted with non water-solubilizing groups such as alkyl or alkyloxy or aryloxy groups, X and Y may not be substituted with water solubilizing groups such as sulfonates or carboxylates. In another aspect, X is a nitro substituted phenyl group and Y is a phenyl group (4) Red Acid Dyes of the Structure

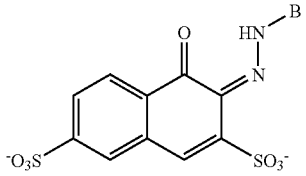

or

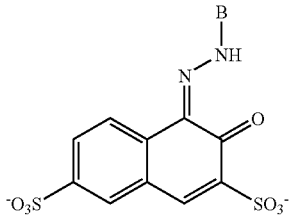

where B is a naphthyl or phenyl group that may be substituted with non water solubilizing groups such as alkyl or alkyloxy or aryloxy groups, B may not be substituted with water solubilizing groups such as sulfonates or carboxylates.

(5) Dis-Azo Dyes of the Structure

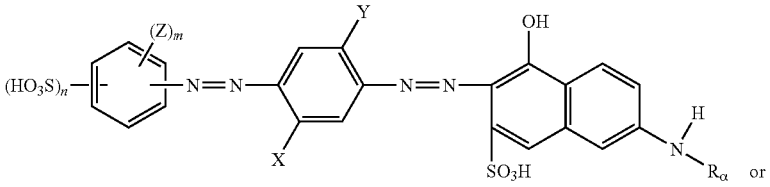

or

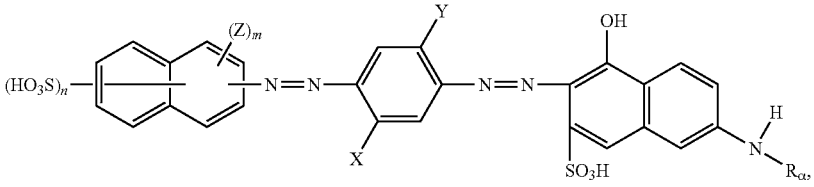

wherein X and Y, independently of one another, are each hydrogen, $C_1$-$C_4$ alkyl or $C_1$-$C_4$-alkoxy, Rα is hydrogen or aryl, Z is $C_1$-$C_4$ alkyl; $C_1$-$C_4$-alkoxy; halogen; hydroxyl or carboxyl, n is 1 or 2 and m is 0, 1 or 2, as well as corresponding salts thereof and mixtures thereof (6) Triphenylmethane Dyes of the Following Structures

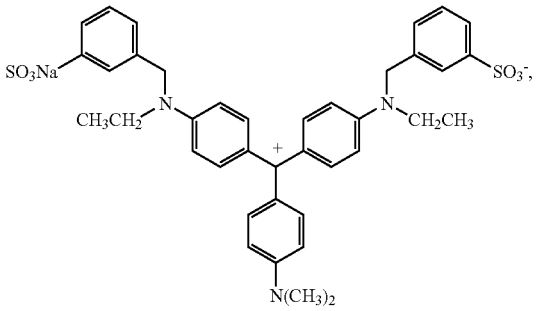

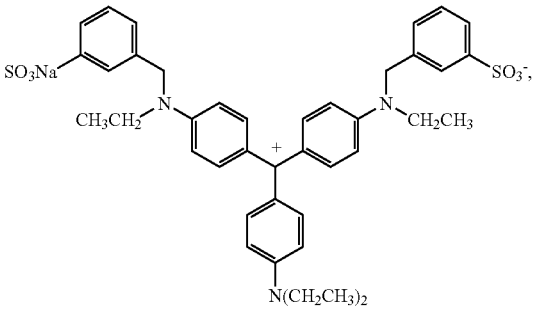

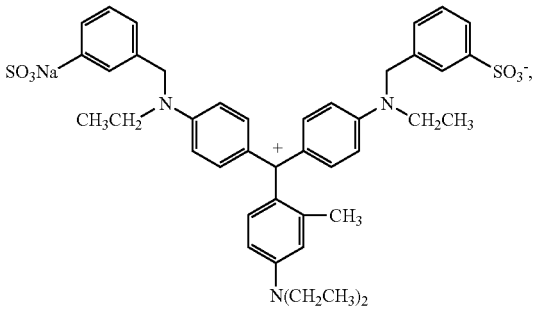

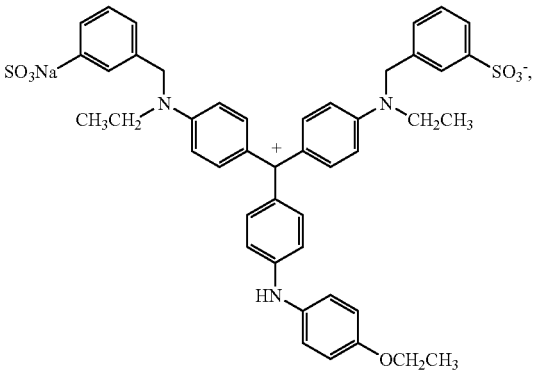

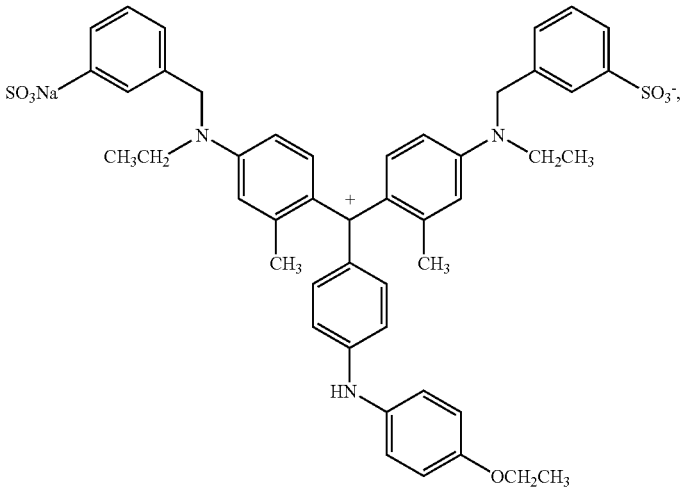

and/or

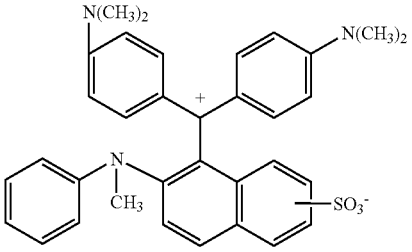

and mixtures thereof.

The hueing dye may be a small molecule dye selected from the group consisting of Colour Index (Society of Dyers and Colourists, Bradford, UK) numbers Direct Violet 9, Direct Violet 35, Direct Violet 48, Direct Violet 51, Direct Violet 66, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Red 52, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof.

Suitable small molecule dyes may include small molecule dyes selected from 1,4-Naphthalenedione, 1-[2-[2-[4-[[4-(acetyloxy)butyl]ethylamino]-2-methylphenyl]diazenyl]-5-nitro-3-thienyl]-Ethanone, 1-hydroxy-2-(1-naphthalenylazo)-Naphthalenedisulfonic acid, ion(2-), 1-hydroxy-2-[[4-(phenylazo)phenyl]azo]-Naphthalenedisulfonic acid, ion (2-), 2-[(1E)-[4-[bis(3-methoxy-3-oxopropyl)amino]-2-methylphenyl]azo]-5-nitro-3-Thiophenecarboxylic acid, ethyl ester, 2-[[4-[(2-cyanoethyl)ethylamino]phenyl]azo]-5-(phenylazo)-3-Thiophenecarbonitrile, 2-[2-[4-[(2-cyanoethyl)ethylamino]phenyl]diazenyl]-5-[2-(4-nitrophenyl)diazenyl]-3-Thiophenecarbonitrile, 2-hydroxy-1-(1-naphthalenylazo)-Naphthalenedisulfonic acid, ion(2-), 2-hydroxy-1-[[4-(phenylazo)phenyl]azo]-Naphthalenedisulfonic acid, ion(2-), 4,4'-[[4-(dimethylamino)-2,5-cyclohexadien-1-ylidene]methylene]bis[N,N-dimethyl-Benzenamine, 6-hydroxy-5-[(4-methoxyphenyl)azo]-2-Naphthalenesulfonic acid, monosodium salt, 6-hydroxy-5-[(4-methylphenyl)azo]-2-Naphthalenesulfonic acid, monosodium salt, 7-hydroxy-8-[[4-(phenylazo)phenyl]azo]-1,3-Naphthalenedisulfonic acid, ion(2-), 7-hydroxy-8-[2-(1-naphthalenyl)diazenyl]-1,3-Naphthalenedisulfonic acid, ion (2-), 8-hydroxy-7-[2-(1-naphthalenyl)diazenyl]-1,3-Naphthalenedisulfonic acid, ion(2-), 8-hydroxy-7-[2-[4-(2-phenyldiazenyl)phenyl]diazenyl]-1,3-Naphthalenedisulfonic acid, ion(2-), Acid Black 1, Acid black 24, Acid Blue 113, Acid Blue 25, Acid blue 29, Acid blue 3, Acid blue 40, Acid blue 45, Acid blue 62, Acid blue 7, Acid Blue 80, Acid blue 9, Acid green 27, Acid orange 12, Acid orange 7, Acid red 14, Acid red 151, Acid red 17, Acid red 18, Acid red 266, Acid red 27, Acid red 4, Acid red 51, Acid red 73, Acid red 87, Acid red 88, Acid red 92, Acid red 94, Acid red 97, Acid Violet 17, Acid violet 43, Basic blue 9, Basic violet 2, C.I. Acid black 1, C.I. Acid Blue 10, C.I. Acid Blue 290, C.I. Acid Red 103, C.I. Acid red 91, C.I. Direct Blue 120, C.I. Direct Blue 34, C.I. Direct Blue 70, C.I. Direct Blue 72, C.I. Direct Blue 82, C.I. Disperse Blue 10, C.I. Disperse Blue 100, C.I. Disperse Blue 101, C.I. Disperse Blue 102, C.I. Disperse Blue 106:1, C.I. Disperse Blue 11, C.I. Disperse Blue 12, C.I. Disperse Blue 121, C.I. Disperse Blue 122, C.I. Disperse Blue 124, C.I. Disperse Blue 125, C.I. Disperse Blue 128, C.I. Disperse Blue 130, C.I. Disperse Blue 133, C.I. Disperse Blue 137, C.I. Disperse Blue 138, C.I. Disperse Blue 139, C.I. Disperse Blue 142, C.I. Disperse Blue 146, C.I. Disperse Blue 148, C.I. Disperse Blue 149, C.I. Disperse Blue 165, I. Disperse Blue 165:1, C.I. Disperse Blue 165:2, C.I. Disperse Blue 165:3, C.I. Disperse Blue 171, C.I. Disperse Blue 173, C.I. Disperse Blue 174, C.I. Disperse Blue 175, C.I. Disperse Blue 177, C.I. Disperse Blue 183, C.I. Disperse Blue 187, C.I. Disperse Blue 189, C.I. Disperse Blue 193, C.I. Disperse Blue 194, C.I. Disperse Blue 200, C.I. Disperse Blue 201, C.I. Disperse Blue 202, C.I. Disperse Blue 205, C.I. Disperse Blue 206, C.I. Disperse Blue 207, C.I. Disperse Blue 209, C.I. Disperse Blue 21, C.I. Disperse Blue 210, C.I. Disperse Blue 211, C.I. Disperse Blue 212, C.I. Disperse Blue 219, C.I. Disperse Blue 220, C.I. Disperse Blue 222, C.I. Disperse Blue 224, C.I. Disperse Blue 225, C.I. Disperse Blue 248, C.I. Disperse Blue 252, C.I. Disperse Blue 253, C.I. Disperse Blue 254, C.I. Disperse Blue 255, C.I. Disperse Blue 256, C.I. Disperse Blue 257, C.I. Disperse Blue 258, C.I. Disperse Blue 259, C.I. Disperse Blue 260, C.I. Disperse Blue 264, C.I. Disperse Blue 265, C.I. Disperse Blue 266, C.I. Disperse Blue 267, C.I. Disperse Blue 268, C.I. Disperse Blue 269, C.I. Disperse Blue 270, C.I. Disperse Blue 278, C.I. Disperse Blue 279, C.I. Disperse Blue 281, C.I. Disperse Blue 283, C.I. Disperse Blue 284, C.I. Disperse Blue 285, C.I. Disperse Blue 286, C.I. Disperse Blue 287, C.I. Disperse Blue 290, C.I. Disperse Blue 291, C.I. Disperse Blue 294, C.I. Disperse Blue 295, C.I. Disperse Blue 30, C.I. Disperse Blue 301, C.I. Disperse Blue 303, C.I. Disperse Blue 304, C.I. Disperse Blue 305, C.I. Disperse Blue 313, C.I. Disperse Blue 315, C.I. Disperse Blue 316, C.I. Disperse Blue 317, C.I. Disperse Blue 321, C.I. Disperse Blue 322, C.I. Disperse Blue 324, C.I. Disperse Blue 328, C.I. Disperse Blue 33, C.I. Disperse Blue 330, C.I. Disperse Blue 333, C.I. Disperse Blue 335, C.I. Disperse Blue 336, C.I. Disperse Blue 337, C.I. Disperse Blue 338, C.I. Disperse Blue 339, C.I. Disperse Blue 340, C.I. Disperse Blue 341, C.I. Disperse Blue 342, C.I. Disperse Blue 343, C.I. Disperse Blue 344, C.I. Disperse Blue 345, C.I. Disperse Blue 346, C.I. Disperse Blue 351, C.I. Disperse Blue 352, C.I. Disperse Blue 353, C.I. Disperse Blue 355, C.I. Disperse Blue 356, C.I. Disperse Blue 357, C.I. Disperse Blue 358, C.I. Disperse Blue 36, C.I. Disperse Blue 360, C.I. Disperse Blue 366, C.I. Disperse Blue 368, C.I. Disperse Blue 369, C.I. Disperse Blue 371, C.I. Disperse Blue 373, C.I. Disperse Blue 374, C.I. Disperse Blue 375, C.I. Disperse Blue 376, C.I. Disperse Blue 378, C.I. Disperse Blue 38, C.I. Disperse Blue 42, C.I. Disperse Blue 43, C.I. Disperse Blue 44, C.I. Disperse Blue 47, C.I. Disperse Blue 79, C.I. Disperse Blue 79:1, C.I. Disperse Blue 79:2, C.I. Disperse Blue 79:3, C.I. Disperse Blue 82, C.I. Disperse Blue 85, C.I. Disperse Blue 88, C.I. Disperse Blue 90, C.I. Disperse Blue 94, C.I. Disperse Blue 96, C.I. Disperse Violet 10, C.I. Disperse Violet 100, C.I. Disperse Violet 102, C.I. Disperse Violet 103, C.I. Disperse Violet 104, C.I. Disperse Violet 106, C.I. Disperse Violet 107, C.I. Disperse Violet 12, C.I. Disperse Violet 13, C.I. Disperse Violet 16, C.I. Disperse Violet 2, C.I. Disperse Violet 24, C.I. Disperse Violet 25, C.I. Disperse Violet 3, C.I. Disperse Violet 33, C.I. Disperse Violet 39, C.I. Disperse Violet 42, C.I. Disperse Violet 43, C.I. Disperse Violet 45, C.I. Disperse Violet 48, C.I. Disperse Violet 49, C.I. Disperse Violet 5, C.I. Disperse Violet 50, C.I. Disperse Violet 53, C.I. Disperse Violet 54, C.I. Disperse Violet 55, C.I. Disperse Violet 58, C.I. Disperse Violet 6, C.I. Disperse Violet 60, C.I. Disperse Violet 63, C.I. Disperse Violet 66, C.I. Disperse Violet 69, C.I. Disperse Violet 7, C.I. Disperse Violet 75, C.I. Disperse Violet 76, C.I. Disperse Violet 77, C.I. Disperse Violet 82, C.I. Disperse Violet 86, C.I. Disperse Violet 88, C.I. Disperse Violet 9, C.I. Disperse Violet 91, C.I. Disperse Violet 92, C.I. Disperse Violet 93, C.I. Disperse Violet 93:1, C.I. Disperse Violet 94, C.I. Disperse Violet 95, C.I. Disperse Violet 96, C.I. Disperse Violet 97, C.I. Disperse Violet 98, C.I. Disperse Violet 99, C.I. Reactive Black 5, C.I. Reactive Blue 19, C.I. Reactive Blue 4, C.I. Reactive Red 2, C.I. Solvent Blue 43, C.I. Solvent Blue 43, C.I. Solvent Red 14, C.I. Acid black 24, C.I. Acid blue 113, C.I. Acid Blue 29, C.I. Direct violet 7, C.I. Food Red 14, Dianix Violet CC, Direct Blue 71, Direct blue 75, Direct blue 78, Direct violet 11, Direct violet 31, Direct violet 5, Direct Violet 51, Direct violet 9, Disperse Blue 106, Disperse blue 148, Disperse blue 165, Disperse Blue 3, Disperse Blue 354, Disperse Blue 364, Disperse blue 367, Disperse Blue 56, Disperse Blue 77, Disperse Blue 79, Disperse blue 79:1, Disperse Red 1, Disperse Red 15, Disperse Violet 26, Disperse Violet 27, Disperse Violet 28, Disperse violet 63, Disperse violet 77, Eosin Y, Ethanol 2,2'-[[4-[(3,5-dinitro-2-thienyl)azo]phenyl]imino]bis-, diacetate (ester), Lumogen F Blue 650, Lumogen F Violet 570, N-[2-[2-(3-acetyl-5-nitro-2-thienyl)diazenyl]-5-(diethylamino)phenyl]-Acetamide, N-[2-[2-(4-chloro-3-cyano-5-formyl-2-thienyl)diazenyl]-5-(diethylamino)phenyl]-Acetamide, N-[5-[bis(2-methoxyethyl)amino]-2-[2-(5-nitro-2,1-benzisothiazol-3-yl)diazenyl]phenyl]-Acetamide, N-[5-[bis[2-(acetyloxy)ethyl]amino]-2-[(2-bromo-4,6-dinitrophenyl)azo]phenyl]-Acetamide, Naphthalimide and derivatives thereof, Oil Black 860, Phloxine B, Pyrazole, Rose Bengal, Sodium 6-hydroxy-5-(4-isopropylphenylazo)-2-naphthalenesulfonate, Solvent Black 3, Solvent Blue 14, Solvent Blue 35, Solvent Blue 58, Solvent Blue 59, Solvent Red 24, Solvent Violet 13, Solvent Violet 8, Sudan Red 380, Triphenylmethane, Triphenylmethane and derivatives thereof, or mixtures thereof.

Suitable polymeric dyes include polymeric dyes selected from the group consisting of polymers containing conjugated chromogens (dye-polymer conjugates) and polymers with chromogens co-polymerized into the backbone of the polymer and mixtures thereof.

In another aspect, suitable polymeric dyes include polymeric dyes selected from the group consisting of fabric-substantive hueing dyes of formula I above available from Milliken (Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, alkoxylated thiazolium polymeric colourants, and mixtures thereof.

The hueing dye may be part of a dye clay conjugate. Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green GI C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green GI C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Adjunct Ingredient

While not essential for the purposes of the present invention, the non-limiting list of adjuncts illustrated hereinafter are suitable for use in the particles and may be desirably incorporated in the particle, for example in the coating layer(s) or in the core of the particle. The skilled person may determine the precise nature of these additional adjunct components, and levels of incorporation thereof. Suitable adjunct materials include, but are not limited to, surfactants, builders, flocculating aid, chelating agents, dye transfer inhibitors, enzymes and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, solvents and/or pigments. The adjunct ingredient may in particular be an enzyme, a perfume, a bleach, a bleach activator, or an additional colorant. When one or more adjuncts are present, such one or more adjuncts may be present as detailed below when defining the adjunct ingredient in the composition comprising the particles.

Process of Making Particles

The particles of the present invention may be made by any process known in the art to prepare particles comprising a core and a coating. In particular, the particles may be prepared according to a process as follows.

Particles may be made by contacting a core and a coating material comprising a binder in a counter-rotating dual-axis paddle mixer.

The coating material may be introduced into said mixer through an ingress located at the bottom of said dual-axis paddle mixer. At the temperature it is introduced, the coating material is preferably a viscous liquid having a viscosity of from 1 mPa·s to 100 000 mPa·s, in particular a viscosity of at least 2 or 5 or 10 or even 20 or 100 mPa·s and/or of at most 10 000 or 5000 or 2000 or 1000 or even 500 mPa·s at a shear rate of 60 $s^{-1}$.

The coating material may be introduced such that said coating material is directed upward into the converging flow zone between the counter-rotating paddles.

Said ingress may comprise a distributor pipe located below the converging flow zone of the counter-rotating paddles said distributor pipe comprising one or more holes.

The coating material may be introduced into said dual-axis paddle at a temperature in excess of the boiling point of a component of said coating material; and/or at a pressure drop of from about 0.1 bar to about 50 bar, from about 1 bar to about 20 bar, or even from about 2 bar to about 10 bar. The boiling point being here evaluated with reference to the pressure in the paddle mixer. In one aspect, said mixer is at ambient pressure.

The particle disclosed in the present application may also be made via the teachings and examples disclosed herein. While only a single mixing unit may be required, multiple mixers may be employed, for example cascading mixers of progressively increasing volume capacity.

The particles disclosed herein may be produced by a process comprising a step of coating of a core, said coating step comprising independently contacting said core with a coating material comprising a binder and another coating material comprising a layering powder and optionally repeating said step of coating;

The step(s) of coating may be conducted at a layering Stokes Number of from greater than 0 to about 10, from about 0.001 to about 10, or even from about 0.01 to about 5; and/or at a Coalescence Stokes Number of at least 0.5, from about 1 to about 1000, or even from about 2 to about 1000.

The cores, the coating material comprising a binder, and optionally the coating material comprising a layering powder may be contacted by introducing the coating material comprising a binder into a counter-rotating dual-axis paddle mixer having a converging flow zone between the counter-rotating paddles such that said coating material comprising a binder is directed upward into the converging flow zone between said counter-rotating paddles.

The cores, the coating material comprising a binder, and the coating material comprising a layering powder may be contacted by introducing the coating material comprising a binder into a counter-rotating dual-axis paddle mixer having multiple layering powder ingress locations and mixing paddles having a downward trajectory, such that the coating material comprising a layering powder is introduced in more than one of said locations in the downward trajectory of the mixing paddles.

The Layering Rate of the process may be from about 5 mass % per minute to about 200% per minute. The Layering Rate of the process may be more than about 10 mass % per minute, more than about 20 mass % per minute, more than 30 mass % per minute, or even more than about 40 mass % per minute.

As it is advantageous to minimize fines and/or over sized products, yet such fines and/or oversized products may still be produced, the particles may be treated to remove fines and oversized products. Such fines and oversized product may be removed and then recycled back into the process for further processing. Oversize product may be processed through a cage grinding mill before being recycled back into the process.

The cores, the coating material comprising a binder, and the coating material comprising a layering powder may be contacted by a process selected from the processes of simultaneously contacting cores with independent streams of said coating material comprising a binder and said coating material comprising a layering powder; contacting said cores in a first location with a stream of said coating material comprising a binder and then contacting said core-coating material comprising a binder component with a stream of said coating material comprising a layering powder in a second location; contacting a core material with a stream of said coating material comprising a layering powder in a first location and then contacting said core-coating material comprising a layering powder component with a stream of coating material comprising a binder in a second location or combination thereof. When more than one layer is required, said contacting process may be repeated one or more times. Said layering process may optionally include, but is not limited to, an air-elutriation step to remove any excess fine particles that are not incorporated into layers.

A ploughshare mixer with a chopper located between the ploughs may be used where cores ingress is directed just below the chopper location and coating material comprising a layering powder ingress is above the chopper location. In this aspect, the circumferential convective flow induced by the main ploughshare impeller is such that the cores are alternately contacted with coating material comprising a binder and coating material comprising a layering powder. In one aspect, a ploughshare mixer is used where the ingress locations of coating material comprising a binder and coating material comprising a layering powder are separated in the axial direction. In one aspect, a continuous ploughshare mixer is used with either axial and/or circumferential separations of coating material comprising a binder and coating material comprising a layering powder.

In one aspect, a counter-rotating dual-axis paddle mixer is used, where the paddles move in an upward trajectory in the space between the parallel counter-rotating shafts and return in a downward trajectory on the outside of the shafts. The motion of the paddles in-between the shafts constitutes a converging flow zone, creating substantial fluidization of the particles in the centre of the mixer. The downward trajectory of the paddles on the outside of the shafts constitutes a downward convective flow. In one aspect, a counter-rotating dual-axis paddle mixer is used where binder ingress is via a top-spray in the central fluidized zone and layering powder ingress is at the sides or corners of the mixer into the downward convective flow. In one aspect, a counter-rotating dual-axis paddle mixer is used where binder ingress is provided by a distributor pipe into the centre zone through the bottom of the mixer, directed into the converging flow zone between the counter-rotating paddles, and layering powder ingress is at a side or corner location of the mixer into the downward convective flow. In one aspect, said layering powder ingress is positioned such that said powder is feed into a downward paddle trajectory of the dual-axis paddle mixer. In these cases, the convective flow induced by the paddle impellers is such that the core material are alternately contacted with coating material comprising a binder and coating material comprising a layering powder in separate locations of the mixer. In one aspect, multiple coating material comprising a layering powder ingress locations are provided.

The layering step may be repeated a sufficient number of times to increase the particle mass by a factor of more than 1.2, or 1.5 or 2 compared to the initial core material mass, more than about four, or even more than about six times the initial core material mass. The layering step may be repeated a sufficient number of times to increase the particles mass by a factor of from about 2 to about 100 compared to the initial core material mass.

The layering steps may be conducted in a single mixer batch process. The layering steps may be conducted in a sequence of two or more batch processes. The layering steps may be conducted in a sequence of two or more batch process mixers with increasing volumetric capacity to accommodate the increase in product volume.

The layering process may be conducted using a series of one or more mixers. The particles of a first mixer may be used as the starting material of a following mixer. The oversized material may be removed by screening, such oversized material may be reduced in size by milling and such milled material may be transported to, for example by a recycle loop, and used in one or more of the processes mixers as a core material. In one aspect, said series of mixers is arranged in a continuous process.

The mass of core and coating material comprising a layering powder may be introduced into the process at separate times but at substantially identical physical locations.

The process may have an average particle residence time of from about greater than 0 minutes to about 60 minutes, from about 1 minute to about 60 minutes, from about 1 minute to 30 minutes, or even from about 2 minutes to 15 minutes.

Suitable equipment for performing the processes disclosed herein includes paddle mixers, dual-axis paddle mixers, ploughshare mixers, ribbon blenders, vertical axis granulators and drum mixers, both in batch and, where available, in continuous process configurations. Such equipment can be obtained from Lodige GmbH (Paderborn, Germany), Littleford Day, Inc. (Florence, Ky., U.S.A.), Dymanic Air (St. Paul, Minn., USA), S. Howes, Inc. (Silver Creek, N.Y., USA), Forberg AS (Larvik, Norway), Glatt Ingenieurtechnik GmbH (Weimar, Germany).

Applicants recognized that Stokes numbers can be used to define processing parameters for layering and agglomeration processes. As such, Applicants' processes may be conducted according to the following process parameters: Layering Stokes Number of less than 10, from about 0.001 to about 10 or even from about 0.001 to about 5, and a Coalescense Stokes Number of greater than 0.5, from about 1 to about 1000 or even from about 2 to about 1000. The aforementioned Stokes numbers can be calculated as indicated is the test method 8.

In another aspect, the particles may be made by a process involving drum mixing or fluid bed drying. The drum mixing may involve a Drum mixer which is a horizontally rotating drum comprising small blades. The fluid bed drying may involve a Fluid Bed Dryer, in which the particles float on a cushion or air or gas. The coating may involve a step of spraying the coating material onto the core.

As will be appreciated by the skilled person, the aforementioned process aspects and those found throughout this specification, including the examples, may be combined in any manner as required to achieve the type and quality of particle that is desired.

Composition Comprising the Particles

The particle of the invention may be part of a detergent or fabric treatment composition such as a laundry detergent composition. The composition may comprise from 0.01 to 99% of the particles of the invention, for example from 0.1 to 10% or from 0.2 to 5% or from 0.5 to 2% or from 1 to 1.5% of particles according to the invention.

While not essential for the purposes of the present invention, the non-limiting list of adjuncts illustrated hereinafter are suitable for use in the instant compositions and may be desirably incorporated in certain embodiments of the invention. The precise nature of these additional adjunct components, and levels of incorporation thereof, will depend on the physical form of the composition and the nature of the cleaning operation for which it is to be used. Suitable adjunct materials include, but are not limited to, surfactants, builders, flocculating aid, chelating agents, dye transfer inhibitors, enzymes and enzyme stabilizers, catalytic materials, bleach activators, bleach catalysts, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, solvents and/or pigments. In addition to the disclosure below, suitable examples of such other adjuncts and levels of use are found in U.S. Pat. Nos. 5,576,282, 6,306,812 B1 and 6,326,348 B1 that are incorporated by reference. When one or more adjuncts are present, such one or more adjuncts may be present as detailed below:

SURFACTANT—The compositions according to the present invention may comprise a surfactant or surfactant system. The compositions may comprise from 0.01% to 90%, or from 1 to 20% or from 2 to 12% or from 5 to 9%, by weight of a surfactant system. The surfactant may be selected from nonionic surfactants, anionic surfactants, cationic surfactants, ampholytic surfactants, zwitterionic surfactants, semi-polar nonionic surfactants and mixtures thereof.

Anionic Surfactants

Typically, the composition comprises from 1 to 50 wt % anionic surfactant, more typically from 2 to 40 wt %.

Suitable anionic surfactants typically comprise one or more moieties selected from the group consisting of carbonate, phosphate, phosphonate, sulphate, sulphonate, carboxylate and mixtures thereof. The anionic surfactant may be one or mixtures of more than one of $C_{8-18}$ alkyl sulphates and $C_{8-18}$ alkyl sulphonates, linear or branched, optionally condensed with from 1 to 9 moles of $C_{1-4}$ alkylene oxide per mole of $C_{8-18}$ alkyl sulphate and/or $C_{8-18}$ alkyl sulphonate.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

Alkoxylated Anionic Surfactants

The composition may comprise an alkoxylated anionic surfactant. When present alkoxylated anionic surfactant will generally be present in amounts form 0.1 wt % to 40 wt %, for example from 1 wt % to 3 wt % based on the composition as a whole.

Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 3 to 7.

Suitable alkoxylated anionic detersive surfactants are: Texapan LESTTM by Cognis; Cosmacol AESTM by Sasol; BES151TM by Stephan; Empicol ESC70/UTM; and mixtures thereof.

Non-Ionic Detersive Surfactant

The compositions of the invention may comprise non-ionic surfactant. Where present the non-ionic detersive surfactant(s) is generally present in amounts of from 0.5 to 20 wt %, or from 2 wt % to 4 wt %.

The non-ionic detersive surfactant can be selected from the group consisting of: alkyl polyglucoside and/or an alkyl alkoxylated alcohol; $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

Cationic Detersive Surfactant

In one aspect of the invention, the compositions are free of cationic surfactant. However, the composition optionally may comprise a cationic detersive surfactant. When present, preferably the composition comprises from 0.1 wt % to 10 wt %, or from 1 wt % to 2 wt % cationic detersive surfactant.

Suitable cationic detersive surfactants are alkyl pyridinium compounds, alkyl quaternary ammonium compounds, alkyl quaternary phosphonium compounds, and alkyl ternary sulphonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium surfactants as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof.

Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

FLOCCULATING AID—The composition may further comprise a flocculating aid. Typically, the flocculating aid is polymeric. Preferably the flocculating aid is a polymer comprising monomer units selected from the group consisting of ethylene oxide, acrylamide, acrylic acid and mixtures thereof. Preferably the flocculating aid is a polyethyleneoxide. Typically the flocculating aid has a molecular weight of at least 100,000 Da, preferably from 150,000 Da to 5,000,000 Da and most preferably from 200,000 Da to 700,000 Da. Preferably the composition comprises at least 0.3% by weight of the composition of a flocculating aid.

BLEACHING AGENTS—The compositions of the present invention may comprise one or more bleaching agents. Suitable bleaching agents other than bleaching catalysts include, but are not limited to, photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject composition. Examples of suitable bleaching agents include, but are not limited to:

(1) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxone®, and mixtures thereof. Suitable percarboxylic acids include, but are not limited to, hydrophobic and hydrophilic peracids having the formula R—(C═O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen;

(2) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, but are not limited to, inorganic salts such as alkali metal silicate, carbonate or borate salts or mixtures thereof, or organic materials such as water-soluble or dispersible polymers, waxes, oils or fatty soaps; and (3) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include, but are not limited to, dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

BLEACH CATALYST—the composition may comprise a bleach catalyst. The bleach catalyst is capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Suitable iminium cations and polyions include, but are not limited to, N-methyl-3,4-dihydroisoquinolinium tetrafluoroborate, prepared as described in Tetrahedron (1992), 49(2), 423-38 (see, for example, compound 4, p. 433); N-methyl-3,4-dihydroisoquinolinium p-toluene sulphonate, prepared as described in U.S. Pat. No. 5,360,569 (see, for example, Column 11, Example 1); and N-octyl-3,4-dihydroisoquinolinium p-toluene sulphonate, prepared as described in U.S. Pat. No. 5,360,568 (see, for example, Column 10, Example 3).

Suitable iminium zwitterions include, but are not limited to, N-(3-sulfopropyl)-3,4-dihydroisoquinolinium, inner salt, prepared as described in U.S. Pat. No. 5,576,282 (see, for example, Column 31, Example II); N-[2-(sulphooxy)dodecyl]-3,4-dihydroisoquinolinium, inner salt, prepared as described in U.S. Pat. No. 5,817,614 (see, for example, Column 32, Example V); 2-[3-[(2-ethylhexyl)oxy]-2-(sulphooxy)propyl]-3,4-dihydroisoquinolinium, inner salt, prepared as described in WO05/047264 (see, for example, page 18, Example 8), and 2-[3-[(2-butyloctyl)oxy]-2-(sulphooxy)propyl]-3,4-dihydroisoquinolinium, inner salt.

Suitable modified amine oxygen transfer catalysts include, but are not limited to, 1,2,3,4-tetrahydro-2-methyl-1-isoquinolinol, which can be made according to the procedures described in Tetrahedron Letters (1987), 28(48), 6061-6064. Suitable modified amine oxide oxygen transfer catalysts include, but are not limited to, sodium 1-hydroxy-N-oxy-N-[2-(sulphooxy)decyl]-1,2,3,4-tetrahydroisoquinoline.

Suitable N-sulphonyl imine oxygen transfer catalysts include, but are not limited to, 3-methyl-1,2-benzisothiazole 1,1-dioxide, prepared according to the procedure described in the Journal of Organic Chemistry (1990), 55(4), 1254-61.

Suitable N-phosphonyl imine oxygen transfer catalysts include, but are not limited to, [R-(E)]-N-[(2-chloro-5-nitrophenyl)methylene]-P-phenyl-P-(2,4,6-trimethylphenyl)-phosphinic amide, which can be made according to the procedures described in the Journal of the Chemical Society, Chemical Communications (1994), (22), 2569-70.

Suitable N-acyl imine oxygen transfer catalysts include, but are not limited to, [N(E)]-N-(phenylmethylene)acetamide, which can be made according to the procedures described in Polish Journal of Chemistry (2003), 77(5), 577-590.

Suitable thiadiazole dioxide oxygen transfer catalysts include but are not limited to, 3-methyl-4-phenyl-1,2,5-thiadiazole 1,1-dioxide, which can be made according to the procedures described in U.S. Pat. No. 5,753,599 (Column 9, Example 2).

Suitable perfluoroimine oxygen transfer catalysts include, but are not limited to, (Z)-2,2,3,3,4,4,4-heptafluoro-N-(nonafluorobutyl)butanimidoyl fluoride, which can be made according to the procedures described in Tetrahedron Letters (1994), 35(34), 6329-30.

Suitable cyclic sugar ketone oxygen transfer catalysts include, but are not limited to, 1,2:4,5-di-O-isopropylidene-D-erythro-2,3-hexodiuro-2,6-pyranose as prepared in U.S. Pat. No. 6,649,085 (Column 12, Example 1).

Preferably, the bleach catalyst comprises an iminium and/or carbonyl functional group and is typically capable of forming an oxaziridinium and/or dioxirane functional group upon acceptance of an oxygen atom, especially upon acceptance of an oxygen atom from a peroxyacid and/or salt thereof. Preferably, the bleach catalyst comprises an oxaziridinium functional group and/or is capable of forming an oxaziridinium functional group upon acceptance of an oxygen atom, especially upon acceptance of an oxygen atom from a peroxyacid and/or salt thereof. Preferably, the bleach catalyst comprises a cyclic iminium functional group, preferably wherein the cyclic moiety has a ring size of from five to eight atoms (including the nitrogen atom), preferably six atoms. Preferably, the bleach catalyst comprises an aryliminium functional group, preferably a bi-cyclic aryliminium functional group, preferably a 3,4-dihydroisoquinolinium functional group. Typically, the imine functional group is a quaternary imine functional group and is typically capable of forming a quaternary oxaziridinium functional group upon acceptance of an oxygen atom, especially upon acceptance of an oxygen atom from a peroxyacid and/or salt thereof.

Preferably, the bleach catalyst has a chemical structure corresponding to the following chemical formula

X

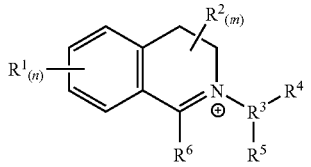

wherein: n and m are independently from 0 to 4, preferably n and m are both 0; each $R^1$ is independently selected from a substituted or unsubstituted radical selected from the group consisting of hydrogen, alkyl, cycloalkyl, aryl, fused aryl, heterocyclic ring, fused heterocyclic ring, nitro, halo, cyano, sulphonato, alkoxy, keto, carboxylic, and carboalkoxy radicals; and any two vicinal $R^1$ substituents may combine to form a fused aryl, fused carbocyclic or fused heterocyclic ring; each $R^2$ is independently selected from a substituted or unsubstituted radical independently selected from the group consisting of hydrogen, hydroxy, alkyl, cycloalkyl, alkaryl, aryl, aralkyl, alkylenes, heterocyclic ring, alkoxys, arylcarbonyl groups, carboxyalkyl groups and amide groups; any $R^2$ may be joined together with any other of $R^2$ to form part of a common ring; any geminal $R^2$ may combine to form a carbonyl; and any two $R^2$ may combine to form a substituted or unsubstituted fused unsaturated moiety; $R^3$ is a $C_1$ to $C_{20}$ substituted or unsubstituted alkyl; $R^4$ is hydrogen or the moiety $Q_t$-A, wherein: Q is a branched or unbranched alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R^5$ is hydrogen or the moiety —$CR^{11}R^{12}$—Y—$G_b$-$Y_c$—$[(CR^9R^{10})_y$—$O]_k$—$R^8$, wherein: each Y is independently selected from the group consisting of O, S, N—H, or N—$R^8$; and each $R^8$ is independently selected from the group consisting of alkyl, aryl and heteroaryl, said moieties being substituted or unsubstituted, and whether substituted or unsubstituted said moieties having less than 21 carbons; each G is independently selected from the group consisting of CO, $SO_2$, SO, PO and $PO_2$; $R^9$ and $R^{10}$ are independently selected from the group consisting of H and $C_1$-$C_4$ alkyl; $R^{11}$ and $R^{12}$ are independently selected from the group consisting of H and alkyl, or when taken together may join to form a carbonyl; b=0 or 1; c can=0 or 1, but c must=0 if b=0; y is an integer from 1 to 6; k is an integer from 0 to 20; $R^6$ is H, or an alkyl, aryl or heteroaryl moiety; said moieties being substituted or unsubstituted; and X, if present, is a suitable charge balancing counterion, preferably X is present when $R^4$ is hydrogen, suitable X, include but are not limited to: chloride, bromide, sulphate, methosulphate, sulphonate, p-toluenesulphonate, borontetraflouride and phosphate.

In one embodiment of the present invention, the bleach catalyst has a structure corresponding to general formula below:

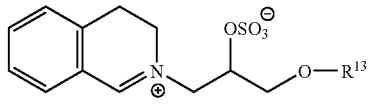

wherein $R^{13}$ is a branched alkyl group containing from three to 24 carbon atoms (including the branching carbon atoms) or a linear alkyl group containing from one to 24 carbon atoms; preferably $R^{13}$ is a branched alkyl group containing from eight to 18 carbon atoms or linear alkyl group containing from eight to eighteen carbon atoms; preferably $R^{13}$ is selected from the group consisting of 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; preferably $R^{13}$ is selected from the group consisting of 2-butyloctyl, 2-pentylnonyl, 2-hexyldecyl, iso-tridecyl and iso-pentadecyl.

BUILDERS—The composition of the present invention may comprise one or more detergent builders or builder systems. When a builder is used, the subject composition will typically comprise at least about 1%, from about 5% to about 60% or even from about 10% to about 40% builder by weight of the subject composition. The composition may comprise less than 15, or less than 10 or less than 5% of builder.

Builders include, but are not limited to, the alkali metal, ammonium and alkanolammonium salts of polyphosphates, alkali metal silicates, alkaline earth and alkali metal carbonates, aluminosilicate builders and polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, citric acid, oxydisuccinic acid, polymaleic acid, benzene 1,3,5-tricarboxylic acid, carboxymethyloxysuccinic acid, and soluble salts thereof.

CHELATING AGENTS—The compositions herein may contain a chelating agent. Suitable chelating agents include, but are not limited to, copper, iron and/or manganese chelating agents and mixtures thereof. When a chelating agent is used, the subject composition may comprise from about 0.005% to about 15% or even from about 3.0% to about 10% chelating agent by weight of the subject composition.

DYE TRANSFER INHIBITING AGENTS—The compositions of the present invention may also include, but are not limited to, one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

BRIGHTENERS—The compositions of the present invention can also contain additional components that may tint articles being cleaned, such as fluorescent brighteners. Suitable fluorescent brightener levels include lower levels of from about 0.01, from about 0.05, from about 0.1 or even from about 0.2 wt % to upper levels of 0.5 or even 0.75 wt %.

DISPERSANTS—The compositions of the present invention can also contain dispersants. Suitable water-soluble organic materials include, but are not limited to, the homo- or copolymeric acids or their salts, in which the polycarboxylic acid comprises at least two carboxyl radicals separated from each other by not more than two carbon atoms.

ENZYMES—The compositions can comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a composition, the aforementioned enzymes may be present at levels from about 0.00001% to about 2%, from about 0.0001% to about 1% or even from about 0.001% to about 0.5% enzyme protein by weight of the composition.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—Applicants' compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, but are not limited to, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, but are not limited to, for example, manganese, iron and chromium. Suitable MRLs include, but are not limited to, 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

The composition may be a cleaning or a detergent composition. The composition may be a fabric-care composition.

The compositions disclosed herein are typically formulated such that, during use in aqueous cleaning operations, the wash water will have a pH of between about 6.5 and about 12, or between about 7.5 and 10.5. Particulate dishwashing product formulations that may be used for hand dish washing may be formulated to provide wash liquor having a pH between about 6.8 and about 9.0. Cleaning products are typically formulated to have a pH of from about 7 to about 12. Techniques for controlling pH at recommended usage levels include, but are not limited to, the use of buffers, alkalis, acids, etc., and are well known to those skilled in the art.

The composition is for example in particulate form, preferably in free-flowing particulate form, although the composition may be in any solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition preferably has a bulk density of from 300 g/l to 1,500 g/l, preferably from 500 g/l to 1,000 g/l.

The composition may be in unit dose form, including not only tablets, but also unit dose pouches wherein the composition is at least partially enclosed, preferably completely enclosed, by a film such as a polyvinyl alcohol film.

The composition may also be in the form of an insoluble substrate, for example a non-woven sheet, impregnated with detergent actives.

The composition may be capable of cleaning and/or softening fabric during a laundering process. Typically, the laundry treatment composition is formulated for use in an automatic washing machine, although it can also be formulated for hand-washing use.

It is to be understood that in the present specification, the percentage and ratio are in weight if not otherwise indicated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

The following examples are given by way of illustration only and therefore should not be construed to limit the scope of the invention.

EXAMPLES

Unless otherwise specified, the mixer that is used in the examples below is a Kenwood Food Processor.

In the following examples, violet hueing dye refers to any of compounds 1-5 of formula I above (about 20% active in a solvent system). The violet hueing dye could be replaced by any other suitable hueing dye.

HLAS is a linear alkyl benzene sulphonic acid supplied by TensaChem (97.3% activity).

Macerated fine carbonate refers to fine sodium carbonate supplied by Brunner Mond which is macerated in a coffee grounder.

The dense carbonate refers to dense sodium carbonate supplied by Brunner Mond and sieved on a 425 μm sieve to keep larger particles.

The spherical carbonate is supplied by Ciech which have been sieved on a 710 μm sieve to keep the larger particles.

Silicate solution refers to a 45% active Silicate 1.6R Solution supplied by Industrial Silicates Ltd.

$TiO_2$ is titanium dioxide supplied under the name P-25® by Degussa Corp.

Example 1

Preparation of Particles A

In this example, Violet hueing dye+HLAS mixture refers to a mixture of 5.27 g of Violet hueing dye with 102.77 g of HLAS.

200 g of dense carbonate are introduced in the mixer as the core material.

Whilst mixing, 40 g of Violet hueing dye+HLAS mixture is added in the mixer to form a binding layer.

Then, whilst mixing, 90 g of macerated fine carbonate is added in the mixer to form a layering powder.

Then, whilst mixing, 40 g of Violet hueing dye+HLAS mixture is added in the mixer.

Then, whilst mixing, 80 g of macerated fine carbonate is then added in the mixer.

Then, whilst mixing, 28.04 g of Violet hueing dye+HLAS mixture is added in the mixer.

Then, whilst mixing, 22 g of macerated fine carbonate is added in the mixer.

Example 2

Preparation of Particles B

In this example carbonate+Violet hueing dye mixture refers to a mixture of 984.10 g of spherical carbonate with 15.80 g of Violet hueing dye.

90 g of carbonate+Violet hueing dye mixture is introduced in the mixer as the core material.

Then, whilst mixing, 10 g of silicate solution is added in the mixer to form a binding layer.

Then, whilst mixing, 23 g of fine macerated carbonate is then added in the mixer.

Then, whilst mixing, 10 g of silicate solution is added in the mixer.

Then, whilst mixing, 50 g of fine macerated carbonate is added in the mixer.

Then, whilst mixing, 8 g of silicate solution is added in the mixer.

Then, whilst mixing, 30 g of fine macerated carbonate is added in the mixer.

Then, whilst mixing, 6 g of silicate solution is added in the mixer.

Then, whilst mixing, 21 g of fine macerated carbonate and 2 g of $TiO_2$ is added in the mixer.

Example 3

Preparation of Particles C 10.53 g of Violet hueing dye was mixed with 989.37 g spherical carbonate in the mixer.

5.5 g of starch was sprayed onto 100 g of this mixture whilst mixing in a drum mixer to give a homogeneous coverage.

Example 4

Preparation of Particles D

To obtain the core material, 5.27 g of Violet hueing dye was mixed with 994.63 g of dense carbonate in a mixer.

4 g of silicate was sprayed onto 82 g of this mixture of the core material in a drum mixer whilst mixing to give a homogeneous binding layer. The particles are heated in an oven at 60° C. While still mixing, 4 g of zeolite is added to this mixture as a layering powder.

3 g of silicate was sprayed onto the above particles whilst mixing in the drum mixer to give a homogeneous binding layer. The coated particles are heated in an oven at 60° C. While still mixing, 2 g of zeolite is added to this mixture as a layering powder.

Again, 3 g of silicate was sprayed onto the above particles whilst mixing in the drum mixer to give a homogeneous binding layer. The coated particles are heated in an oven at 60° C. While still mixing, 2 g of zeolite is added to this mixture as a layering powder.

Particles A-D of examples 1-4 have an average diameter of between about 0.3 mm and 1 mm.

Example 5

Preparation of Laundry Compositions Comprising the Particles A, B, C, or D

The following compositions are prepared by dry adding the particles A, B, C, or D and then spraying the non-ionic surfactant and the perfume.

| Ingredients | Concentration (weight percentage) | | | |
|---|---|---|---|---|
| non-ionic surfactant | 1.5-2.0 | 1.5-2.0 | 1.5-2.0 | 1.5-2.0 |
| cationic surfactant | 0.5-1.0 | 0.5-1.0 | 0.5-1.0 | 0.5-1.0 |
| anionic surfactant (such as LAS) | 8.0-12.0 | 8.0-12.0 | 8.0-12.0 | 8.0-12.0 |
| Phosphate builders | 15.0-20.0 | 15.0-20.0 | 15.0-20.0 | 15.0-20.0 |
| zeolite | 3.0-4.0 | 3.0-4.0 | 3.0-4.0 | 3.0-4.0 |
| citric acid | 1.0-2.0 | 1.0-2.0 | 1.0-2.0 | 1.0-2.0 |
| chelant | 0.5-1.0 | 0.5-1.0 | 0.5-1.0 | 0.5-1.0 |
| silicate | 4.0-6.0 | 4.0-6.0 | 4.0-6.0 | 4.0-6.0 |
| anti-redeposition polymers | 2.0-3.0 | 2.0-3.0 | 2.0-3.0 | 2.0-3.0 |
| brightener | 0.1-0.2 | 0.1-0.2 | 0.1-0.2 | 0.1-0.2 |
| bleach and bleach activator | 15.0-20.0 | 15.0-20.0 | 15.0-20.0 | 15.0-20.0 |
| enzymes | 0.3-0.5 | 0.3-0.5 | 0.3-0.5 | 0.3-0.5 |
| sulfate | 10.0-20.0 | 10.0-20.0 | 10.0-20.0 | 10.0-20.0 |
| carbonate | 10.0-20.0 | 10.0-20.0 | 10.0-20.0 | 10.0-20.0 |
| miscelaneous, perfume | 0.0-2.0 | 0.0-2.0 | 0.0-2.0 | 0.0-2.0 |
| water | 4.0-6.0 | 4.0-6.0 | 4.0-6.0 | 4.0-6.0 |
| particles A | 1.5 | | | |
| particles B | | 3.0 | | |
| particles C | | | 1.67 | |
| particles D | | | | 3.80 |
| total | 100 | 100 | 100 | 100 |

Those four compositions (with particles A, B C, or D) are showing no significant bleeding of the dye. No significant spotting is observed on the fabric when washed with these compositions.

Example 6

Preparation of Laundry Compositions Comprising the Particles

The following compositions are prepared by dry adding the particles A or B and then spraying the non-ionic surfactant and the perfume.

| Ingredients | Concentration (weight percentage) | |
|---|---|---|
| non-ionic surfactant | 1.5-2.0 | 1.5-2.0 |
| cationic surfactant | 0.5-1.0 | 0.5-1.0 |
| anionic surfactant (such as LAS) | 8.0-12.0 | 8.0-12.0 |
| Phosphate builders | 3.0-6.0 | 0.0-1.0 |
| zeolite | 0.0-1.0 | 0.0-1.0 |
| citric acid | 1.0-2.0 | 1.0-2.0 |

-continued

| Ingredients | Concentration (weight percentage) | |
|---|---|---|
| chelant | 0.5-1.0 | 0.5-1.0 |
| silicate | 4.0-6.0 | 4.0-6.0 |
| anti-redeposition polymers | 2.0-3.0 | 2.0-3.0 |
| brightener | 0.1-0.2 | 0.1-0.2 |
| bleach and bleach activator | 15.0-20.0 | 15.0-20.0 |
| enzymes | 0.3-0.5 | 0.3-0.5 |
| sulfate | 15.0-25.0 | 15.0-25.0 |
| carbonate | 15.0-25.0 | 15.0-25.0 |
| miscelaneous, perfume | 0.0-2.0 | 0.0-2.0 |
| water | 4.0-6.0 | 4.0-6.0 |
| particles A | 1.5 | |
| particles B | | 3.0 |
| total | 100 | 100 |

Test Methods

The test methods that are disclosed below can be used to determine the respective values of the parameters as described and claimed herein.

Test Method 1: Measurement of a Particle Size Distribution and a Mean Particle Size.

The particle size distribution of granular detergent products, intermediates and raw materials are measured by sieving the granules/powders through a succession of sieves with gradually smaller dimensions. The weight of material retained on each sieve is then used to calculate a particle size distribution and median or mean particle size.

Equipment: RoTap Testing Sieve Shaker Model B (as supplied by: W.S. Tyler Company, Cleveland, Ohio), supplied with cast iron sieve stack lid with centrally mounted cork. The RoTap should be bolted directly to a flat solid inflexible base, typically the floor. The tapping speed used should be 6 taps/minute with a 12 rpm elliptical motion. Samples used should weight 100 g, and total sieving time should be set at 5 mins.

Particle Size Distribution: The fraction on each sieve is calculated from the following equation:

$$\text{Fraction on sieve (\%)} = \frac{\text{Mass on sieve (g)} \times 100}{\text{Orignal sample weight (g)}}$$

If this calculation is done for each sieve size used then a particle size distribution is obtained. However a cumulative particle size distribution is of more use: The cumulative distribution is calculated by adding the fractions on a particular sieve to the fractions on sieves above it (i.e. of higher mesh size).

Calculation of Mean particle size: Mean Particle Size is the geometric mean particle size on a mass basis calculated as the X intercept of the weighted regression line on the sigma versus log (size) plot.

Test Method 2: Bulk Density Test

The core material bulk density is determined in accordance with Test Method B, Loose-fill Density of Granular Materials, contained in ASTM Standard E727-02, "Standard Test Methods for Determining Bulk Density of Granular Carriers and Granular Pesticides," approved Oct. 10, 2002.

Test Method 3: Particle Aspect Ratio Test

The particle aspect ratio is defined as the ratio of the particle's major axis diameter ($d_{major}$) relative to the particle's minor axis diameter ($d_{minor}$), where the major and minor axis diameters are the long and short sides of a rectangle that circumscribes a 2-dimensional image of the particle at the point of rotation where the short side of the rectangle is minimized. The 2-dimensional image is obtained using a suitable microscopy technique. For the purpose of this method, the particle area is defined to be the area of the 2-dimensional particle image.

In order to determine the aspect ratio distribution and the median particle aspect ratio, a suitable number of representative 2-dimensional particle images must be acquired and analyzed. For the purpose of this test, a minimum of 5000 particle images is required. In order to facilitate collection and image analysis of this number of particles, an automated imaging and analysis system is recommended. Such systems can be obtained from Malvern Instruments Ltd., Malvern, Worcestershire, United Kingdom; Beckman Coulter, Inc., Fullerton, Calif., USA; JM Canty, Inc., Buffalo, N.Y., USA; Retsch Technology GmbH, Haan, Germany; and Sympatec GmbH, Clausthal-Zellerfeld, Germany.

A suitable sample of particles is obtained by riffling. The sample is then processed and analyzed by the image analysis system, to provide a list of particles containing major and minor axis attributes. The aspect ratio (AR) of each particle is calculated according to the ratio of the particle's major and minor axis, $$AR=d_{major}/d_{minor}.$$

The list of data are then sorted in ascending order of particle aspect ratio and the cumulative particle area is calculated as the running sum of particle areas in the sorted list. The particle aspect ratio is plotted against the abscissa and the cumulative particle area against the ordinate. The median particle aspect ratio is the abscissa value at the point where the cumulative particle area is equal to 50% of the total particle area of the distribution.

Test Method 4: Measurement of the Sphericity

The sphericity is taken on a two-dimensional projected image of the granulated detergent particles and the sphericity Ψ is defined by the equation given below.

$$\Psi=(ML^2\times\pi)/(4\times A)\times 100$$

Where, ML stands for a maximum length of the particles [in μm]; and A stands for an area of a projected image of the granulated detergent particles [in $\mu m^2$]. The average sphericity is a mean value of values obtained by measuring 300 granulated detergent particles.

Test Method 5: Fabric Substantive Component Test

1.) Fill two tergotometer pots with 800 ml of water having a water hardness of 14.4 English Clark Degrees Hardness with a 3:1 Calcium to Magnesium molar ratio.
2) Insert pots into tergotometer, with water temperature controlled at 30° C. and agitation set at 40 rpm for the duration of the experiment.
3) Add 4.8 g of IEC-B detergent (IEC 60456 Washing Machine Reference Base Detergent Type B), supplied by wfk, Bruggen-Bracht, Germany, to each pot.
4) After two minutes, add 2.0 mg of the component to be tested to the first pot.
5) After one minute, add 50 g of flat cotton vest (supplied by Warwick Equest, Consett, County Durham, UK), cut into 5 cm×5 cm swatches, to each pot.
6) After 10 minutes, drain the pots and re-fill with cold Water (16° C.) having a water hardness of 14.4 English Clark Degrees Hardness with a 3:1 Calcium to Magnesium molar ratio.
7) After 2 minutes rinsing, remove fabrics.
8) Repeat steps 3-7 for a further three cycles using the same treatments.
9) Collect and line dry the fabrics indoors, in the dark, for 12 hours.
10) Analyze the swatches using a Hunter Miniscan spectrometer fitted with D65 illuminant, 10° observer, and UVA cutting filter, to obtain Hunter a (red-green axis) and Hunter b (yellow-blue axis) values.
11) Average the Hunter a and Hunter b values for each set of fabrics to deduce the average difference in hue on the a and b axis between the two sets of fabrics.

Test Method 6: Hueing Efficiency

A 25 cm×25 cm fabric piece of 16 oz cotton interlock knit fabric (270 g/square meter, brightened with Uvitex BNB fluorescent whitening agent, obtained from Test Fabrics. P.O. Box 26, Weston, Pa., 18643), is employed. The samples are washed in one litre of distilled water containing 1.55 g of AATCC standard heavy duty liquid (HDL) test detergent as set forth in Table 1 of U.S. Pat. No. 7,208,459, for 45 minutes at room temperature and rinsed by allowing to stand undisturbed with 500 mL of distilled water at 25° C. for 5 minutes, then filtering off the rinse water. Respective samples are prepared using a detergent containing no dye (control) and using a detergent containing a 30 ppm wash concentration of a dye to be tested. After rinsing and then air drying during 24 hours at 25° C. in the dark each fabric sample, the hueing efficiency, $DE^*_{eff}$, in the wash is assessed by the following equation:

$$DE^*_{eff}=((L^*_c-L^*_s)^2+(a^*_c-a^*_s)^2+(b^*_c-b^*_s)^2)^{1/2}$$

wherein the subscripts c and s respectively refer to the L*, a*, and b* values measured for the control, i.e., the fabric sample washed in detergent with no dye, and the fabric sample washed in detergent containing the dye to be screened. The L*, a*, and b* value measurements are carried out using a Hunter Colorquest reflectance spectrophotometer with D65 illumination, 10° observer and UV filter excluded.

Test Method 7: Viscosity Test

The viscosity is determined using an apparent viscosity obtained by the Brookfield test method. A suitable viscometer, for example Brookfield type LV (LVT or LVDV series) with UL adapter, can be obtained from Brookfield Engineering Laboratories, Inc., Middleboro, Mass., USA. The coating material component viscosity test is conducted in accordance with the Brookfield Operating Manual, following the guidelines of ISO 2555, second edition published Feb. 1, 1989 and reprinted with corrections Feb. 1, 1990, "Plastics—resins in the liquid state or as emulsions or dispersions—Determination of apparent viscosity by the Brookfield Test method," with the following qualifications:

a.) A Brookfield LV series viscometer with UL adapter is used.
b.) It is recommended to use a rotational frequency of 60 revolutions per minute. The spindle shall be chosen in accordance with the permitted operating range specified in Clause 4 of ISO 2555. In case the rotational frequency of 60 revolutions per minute cannot be used based on the permitted operating range, then the highest speed that is less than 60 revolutions per minute and is in accordance with the permitted range of Clause 4 shall be used.
c.) The viscosity measurement is performed at the temperature at which the viscosity is to be measured.

Test Method 8: Calculation of the Stokes Numbers.

This method must be used for strokes numbers calculation.

$$St_{mixer}=(0.0001)\cdot N\cdot R\cdot\rho\cdot\delta/\eta$$

The variables in the above equation are specified with units of measurement as follows:

N is the rotational speed of the main agitation impeller shaft in the mixer (revolutions per minute, abbreviated as RPM)

R in radial sweep distance of the main agitation impeller, from the center of the impeller shaft to the tip of the impeller tool (meters, abbreviated as m);

ρ is bulk density of the core materials particles (grams/liter, abbreviated as g/l);

η is coating material viscosity (centipoises, abbreviated as cp); and

δ is effective particle size used to describe layering or agglomeration (microns, abbreviated as um), where:

$\delta_{layering}$ is defined as $2\cdot(d_{core\ material}\cdot d_{layering})/(d_{core\ material}+d_{layering})$, and $\delta_{coalescence}$ is defined as $d_{core\ material}$; where $d_{core\ material}$ is the median particle size of the core material, and $d_{layering}$ is the median particle size of the coating material comprising a layering powder material.

Based on the above, two sub-forms of the Stokes equation can be defined, one to describe the binding of the coating material comprising a layering powder onto the core material particles ($St_{layering}$), and another to describe the coalescence of core material particles with other core materials ($St_{coalescence}$).

$$\text{Layering Stokes Number, } St_{layering}=(0.0001)\cdot N\cdot R\cdot\rho\cdot\delta_{layering}/\eta$$

$$\text{Coalescence Stokes Number, } St_{coalescence}=(0.0001)\cdot N\cdot R\cdot\rho\cdot\delta_{coalescence}/\eta$$

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A particle, for use in a detergent composition, comprising:

at least 2n coating layers comprising a binder selected from the group consisting of surfactant, surfactant precursor, film-forming polymer, film forming inorganic salt, and mixtures thereof, wherein n=1 to less than 10 and a core being at least partially coated by said at least 2n coating layers;

wherein the particle comprises a hueing dye in said core and in at least 2n coating layers the hueing dye having the structure of formula I:

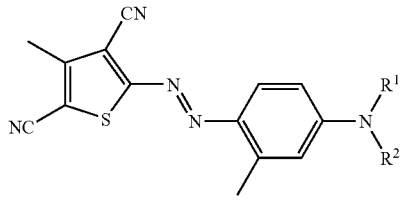

wherein each $R^1$ and $R^2$ are independently selected from the group consisting of R, —$[(CH_2CR'HO)_x(CH_2CR''HO)_yH]$, and mixtures thereof, wherein R is independently selected from H, $C_1$-$C_4$ linear or branched alkyl, benzyl and mixtures thereof; each R' is independently selected from the group consisting of H, $CH_2O(CH_2CH_2O)_zH$, and mixtures thereof, and each R" is selected from the group consisting of H, $CH_3$, $CH_2O(CH_2CH_2O)_zH$, and mixtures thereof; wherein $x+y\leqq 5$; wherein $y\geqq 1$; and wherein z=0 to 5, and further wherein the concentration of hueing dye in the n first coating layers being higher than the concentration of hueing dye in the n last coating layers.

2. The particle of claim 1, comprising at least two coating layers comprising a coating material selected from the group consisting of surfactant, surfactant precursor, builders, buffering agents, soluble polymers, optical brighteners, metal oxides, film-forming polymer, film-forming inorganic salt, and mixtures thereof.

3. The particle of claim 1, wherein the core is solid at 25° C. and has a size of from about 150 microns to about 1700 microns.

4. The particle of claim 1, having a mean particle size of at least about 200 μm.

5. A composition containing at least about 0.05% by weight of particles according to claim 1 and a cleaning adjunct material.

6. A process to prepare a particle as defined in claim 1, comprising the step of layering a mass of cores by a layering process comprising independently contacting said mass of cores with a coating material comprising a liquid coating material having a viscosity of from about 1 mPa·s to about 4000 mPa·s.

* * * * *